United States Patent [19]

Bengtsson et al.

[11] 4,130,927

[45] Dec. 26, 1978

[54] PROCESS AND AN APPARATUS FOR THE CONTINUOUS MECHANICAL FABRICATION OF STARTING SHEETS FOR THE ELECTROLYTIC REFINING OF METALS, ESPECIALLY COPPER

[75] Inventors: Ralph Bengtsson; Gunnar Larsson, both of Karlstad, Sweden

[73] Assignee: C J Wennberg AB, Sweden

[21] Appl. No.: 790,871

[22] Filed: Apr. 26, 1977

[30] Foreign Application Priority Data

Apr. 28, 1976 [DE] Fed. Rep. of Germany ..... 2618679
Oct. 2, 1976 [DE] Fed. Rep. of Germany ..... 2644631

[51] Int. Cl.[2] ..... B23P 11/00
[52] U.S. Cl. ..... 29/432.1; 29/521; 29/715; 29/798
[58] Field of Search ..... 29/432.1, 432.2, 521, 29/715, 788, 796, 798, 822, 283.5

[56] References Cited

U.S. PATENT DOCUMENTS

| | | | |
|---|---|---|---|
| 2,927,548 | 3/1960 | Wellington | 29/521 UX |
| 3,465,414 | 9/1969 | Koett | 29/432.2 |
| 3,766,621 | 10/1973 | Schwardt | 29/796 |

*Primary Examiner*—Victor A. Dipalma
*Attorney, Agent, or Firm*—Craig & Antonelli

[57] ABSTRACT

A process and apparatus for the continuous mechanical fabrication of starting sheets for the electrolytic refining of metals, especially copper, from electrolytically deposited sheets which have already been cut to certain dimensions and straightened, the sheets being continuously moved forward along a predetermined path of movement at a substantially constant rate of advance and a movement component directed parallel to the path of movement of the sheets, of which the speed substantially corresponds to the rate of advance of the sheets, being imparted both to the components to be connected to the sheets and to the tools, at least when they are acting directly or indirectly on the sheets.

31 Claims, 12 Drawing Figures

PROCESS AND AN APPARATUS FOR THE CONTINUOUS MECHANICAL FABRICATION OF STARTING SHEETS FOR THE ELECTROLYTIC REFINING OF METALS, ESPECIALLY COPPER

This invention relates to a process for the continuous mechanical fabrication of starting sheets for the electrolytic refining of metals, especially copper, from electrodeposited sheets which have already been cut to certain dimensions and straightened, the sheets being moved forward along a predetermined path of movement and being connected through supporting eyes to the cathode bar by means of the intermittently operating tools arranged at certain points along this path, in particular by means of a punch which acts as a stamping or cutting tool and which comprises oblique surfaces acting as a bending tool. The invention also relates to an apparatus for carrying out this process, consisting of a transporting system for the sheets, supporting eyes and cathode bars and of stamping tools and tools for establishing a firm, rigid connection between the supporting eyes and the sheets, more particularly of a punch provided with a cutting edge and with oblique surfaces.

The electrolytic refining of metals, especially copper, is carried out with so-called starting sheets which are also known as "substrates". These substrates are copper layers electrolytically deposited onto so-called "mother sheets" from which they are removed and, provided with supporting eyes and cathode bars, are subsequently suspended as starting sheets or cathodes in the electrolytic refining baths.

The crude starting sheets are subjected to further machining, in other words they have first to be cut to size and straightened, after which the sheets thus treated are joined to the supporting eyes and the cathode bars.

The production of the starting sheet cathodes is described, for example, in Ullmann, "Encyklopadie der chemischen Technologie", 3rd Edition, Vol. 11, page 198 (1960).

All hitherto known apparatus and machines for the mechanical production of starting sheets are attended by the serious disadvantage of a limited capacity. According to the prior art, the sheets, having been cut to size and straightened, are guided stepwise, i.e. intermittently, through the apparatus in a mainly horizontal plane, after which they are turned into the horizontal position by a suitable arrangement.

A process and an apparatus for the mechanical production of cathode sheet units, i.e. starting sheets, for the electrolytic refining of copper are described in German Patent specification No. 1,188,299. In this case, the straightened sheets are moved forward in a substantially horizontal plane, one cathode bar being placed in the path of movement of each sheet and being brought into contact with suspension strips (supporting eyes) delivered perpendicularly of the direction of movement. These suspension strips are taken up by the advancing cathode bar, bent around it and fastened to the sheet in known manner, after which the now ready starting sheets suspended from the cathode bars are erected and are conveyed in this position into a magazine or directly into the electrolytic copper refining bath.

The apparatus for carrying out this process known from German Patent Specification No. 1,188,299 consists essentially of a vertically displaceable roller table which picks up the sheets and deposits them onto a conveyor belt, and of a continuous-throughput station with a stacker for the cathode bars; also of two successive chain conveyors, of a continuous-throughput station with tools known per se and of a tilting table and a stacking system.

This apparatus, on which the present invention is based as prior art, is attended by the following disadvantages.

The stepwise, i.e. intermittent, feeding of the sheets, supporting eyes and bars requires precision control for maintaining the necessary interval between the sheets and the bar. At the same time, the very thin cathode sheet is subjected to strong acceleration and deceleration forces which inter alia often result in changes in the above-mentioned interval and in deformation of the sheets by the control edges of the conveyor system, as a result of which the starting sheets become unuseable so that capacity is reduced. The intermittent feed and, hence, the stoppages in the forward movement are primarily attributable to the operations involved in connecting the supporting eyes to the sheets, for example the stamping and riveting operations or other connecting operations.

Although a gentle, rather than sudden deceleration before and a corresponding acceleration after a stoppage for a connecting operation, for example the stamping and riveting operation, cause less damage, they reduce the capacity of the installation so that it becomes uneconomical. Although the capacity of conventional machines can be increased to an optimal level by a sudden, i.e. rapid deceleration and a corresponding acceleration and by connecting operations involving very short stoppages, the above-mentioned disadvantages, namely damage to the finished starting sheets, still arise.

The object of the present invention is to provide a process and an apparatus for the continuous mechanical fabrication of starting sheets which do not have any of the disadvantages referred to above, i.e. which enable starting sheets to be fabricated without errors, but nevertheless with high capacity and in rapid succession. The first connection between the supporting eyes and the sheet is intended to be sufficient to hold these components together and to be converted into a final, firm connection by as few operations as possible.

According to the invention, this object is achieved by virtue of the fact that the sheet is continuously moved forward along the predetermined path of movement at a substantially constant rate of advance, and by virtue of the fact that a movement component directed parallel to the path of movement of the sheet, of which the speed substantially corresponds to the rate of advance of the sheet, is imparted to the components to be connected to the sheet and to the tools, at least when they are acting directly or indirectly on the sheet.

In order to establish a connection between the supporting eyes and the sheet, a punch provided at least with a front cutting edge and with oblique surfaces acting as bending tools is punched shotwise at high speed through the supporting eyes and the sheet.

Preferably, the process according to the invention is further distinguished by the fact that the tools act on the sheet in limited zones substantially perpendicularly of the plane of the sheet, and by the fact that the sheet is supported by counter tools and/or by the path of movement at least in its zones adjacent, preferably immediately adjacent, the contact point of the tools and/or the forces applied by the tools to the sheet non-perpendicularly of the plane thereof are applied in pairs in substantially the same magnitude and in opposite directions in such a way that the resulting force component in the plane of the sheet is substantially zero.

According to the invention, it is advantageous for the displaceable tools which are used for connecting the sheet through supporting eyes to a cathode bar, and the associated counter tools to be moved along closed paths, preferably along circular paths, which are arranged in such a way that they are contacted substantially tangentially by the path of movement of the sheet.

The process according to the invention is distinguished by the fact that the sheet, the supporting eyes and the cathode bar are continuously advanced and by the fact that, during this continuous advance movement for continuously carrying out the operations by which the sheet and supporting eyes are connected, the sheet metal strips forming the supporting eyes are bent around the cathode bar so that they are in contact with the sheet on both sides at their two ends, and a first connection is then established by means of a punching operation through the ends of the supporting eyes and through the sheet to form tongues and this first connection is converted into a firm, rigid connection by subsequent bending over and/or riveting of the tongues.

In one preferred embodiment of the process according to the invention, a punch provided at least with a front cutting edge and with oblique surfaces acting as bending tools is punched shotwise at high speed through the supporting eyes and the sheet to establish a connection between the supporting eyes and the sheet.

The punch used for this purpose has a rectangular, preferably square cross-section and comprises oblique surfaces which extend rearwardly gable-fashion from the front cutting edge preferably extending substantially parallel to the surface of the sheet and, with the lateral surfaces of the punch, form lateral cutting edges which, when the punch is applied, cut into the sheet and the supporting eyes tongues which are bent to the side by the gable-like oblique surfaces of the punch. The advantage of using a punch such as this provided with lateral cutting edges is that the tongues are cut smoothly into the sheets. It is advantageous to use a punch of which the oblique surfaces are formed in such a way that they include an angle of from about 50° to about 70° and preferably an angle of about 60°.

In the process according to the invention, the punch is fired into the sheet assembled formed by the sheet and the supporting eyes by means of the suddenly released spring tension and/or pneumatically by means of expanded compressed air or gases.

The apparatus according to the invention for carrying out the process comprising a transporting system designed to be driven continuously at a constant speed for the sheets, supporting eyes and cathode bars, and punching tools and tools for mechanically establishing a firm, rigid connection between the supporting eyes and the sheets, is distinguished by the fact that it comprises: a transporting system for advancing the cathode bars and the sheets, the carriers for the cathode bars and stops for the sheets and also conveyor means for maintaining a constant interval between the cathode bar and the sheet during the advance movement in the first part of the conveyor system, and stationary means for picking up and holding sheet metal strips which are used to form the supporting eyes and which are bent around the cathode bar during its advancing movement, the ends of the supporting eyes formed from these sheet metal strips resting on both sides of the sheet at its upper end, and displaceable tools for connecting the ends of the supporting eyes to the sheet.

The displaceable tools for connecting the ends of the supporting eyes to the sheet are arranged along curved paths on displaceable bodies, more especially rotating bodies, with or without a curved surface, more especially rollers, wheels or segments thereof, which are provided at the necessary places with cutouts for the passage of the cathode bars.

The apparatus according to the invention is further distinguished by the fact that the displaceable tools comprise at least one co-operating pair of rollers or wheels for simultaneously punching out tongues both from the supporting eyes and from the sheets and at least one co-operating pair of rollers or wheels for bending over the tongues punched out and at least one co-operating pair of rollers or wheels for establishing the firm, rigid connection by compression, riveting or welding of the tongues.

A punching or cutting tool is preferably mounted for radial displacement on at least one roller of the pair of rollers used for punching out the tongues in such a way that it can be displaced into the path of movement of the sheet beyond the circumference of the roller, this punching or cutting tool being in the form of a punch which is provided with a front cutting edge and with oblique surfaces acting as bending tools and which is adapted to be fired like a shot at high speed through the supporting eyes and the sheet under the tension of one or more suddenly releasable springs.

Several rollers with an increasing wedge angle are arranged one behind the other in the direction of movement along the path of movement of the sheet for successively bending over the tongues, whilst the punch has a rectangular, preferably square cross-section and is provided with oblique surfaces which extend rearwardly gable-fashion from the front cutting edge preferably extending substantially parallel to the surface of the sheet and form lateral cutting edges with the lateral surfaces of the punch.

The punch is preferably supported by a yoke-like member which is mounted for radial displacement in one wheel of the pair of wheels used for forming the tongues and is arranged to be biased by means of springs which, with each revolution of this wheel, are designed to be automatically tensioned by means of a stretching yoke pivotal from its working position into its rest position and to be suddenly released when the punch aligns with an opening in a projection, acting as abutment, on the other wheel of the pair of wheels.

Other features of the apparatus according to the invention are based on the fact that the cocking lever is adapted to be automatically pivoted from its working position into its rest position in dependence upon the presence of a sheet, a cathode bar and/or supporting eyes, and on the fact that at least one wheel of the pair of wheels used to establish a first connection is spring-mounted.

An embodiment of the invention is described by way of example in the following with reference to the accompanying drawings, wherein.

Figure 1:
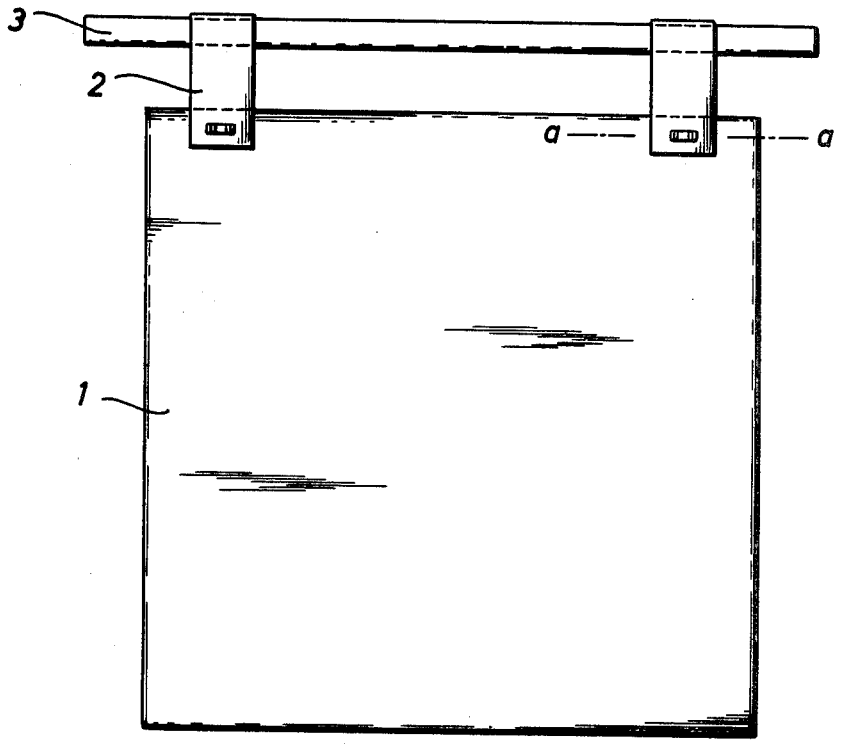
FIG. 1 shows a finished starting plate for the electrolytic refining of metals, especially copper.

The finished starting sheet 1 illustrated in FIG. 1 is connected through two supporting eyes 2 to a cathode bar 3. In the apparatus for the mechanical fabrication of starting sheets illustrated in FIGS. 4 and 5, the sheet 1, the cathode bars 3 and the supporting eyes 2 formed from sheet metal strips 2' are advanced by the tools over a preferably horizontal path. The edgecutting and straightening of the sheet are carried out before it is delivered to the apparatus illustrated in FIGS. 4 and 5, delivery being to the right-hand side of the apparatus. The apparatus shown in FIGS. 4 and 5 comprises the main chain conveyors 5,6 and 8,9 which are used for advancing the individual components of the starting sheets before their delivery during assembly and also the assembled starting sheet. These chain conveyors and also the other displaceable parts of the apparatus as a whole are continuously driven by means of a common drive (not shown) through a main shaft 19. This shaft 19 may be driven by hydraulic motors, direct-current motors, alternating-current motors or in any other way. The displaceable elements 13, 14, 15, 16, 17 and 18 described hereinafter for connecting the ends of the supporting eyes 2 to the sheet 1 may be synchronized through auxiliary drive elements 20 in the form of gearwheels, gear belts or the like.

Figure 4:
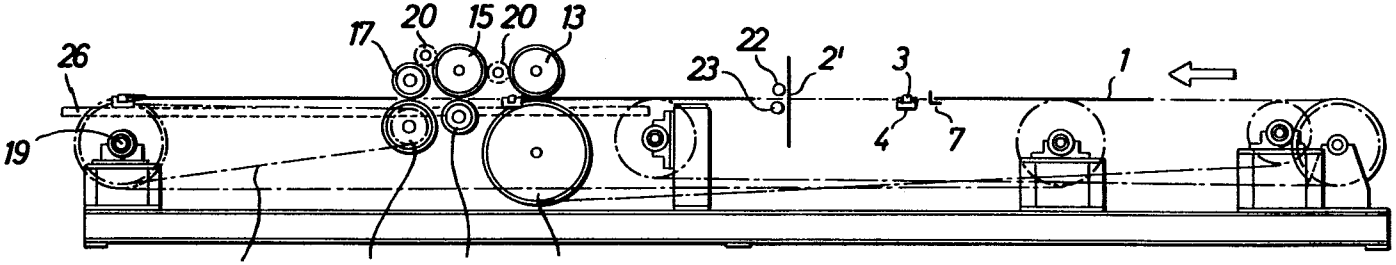
FIG. 4 is a side elevation of an embodiment of the apparatus according to the invention for the mechanical fabrication of starting sheets.
Figure 5:
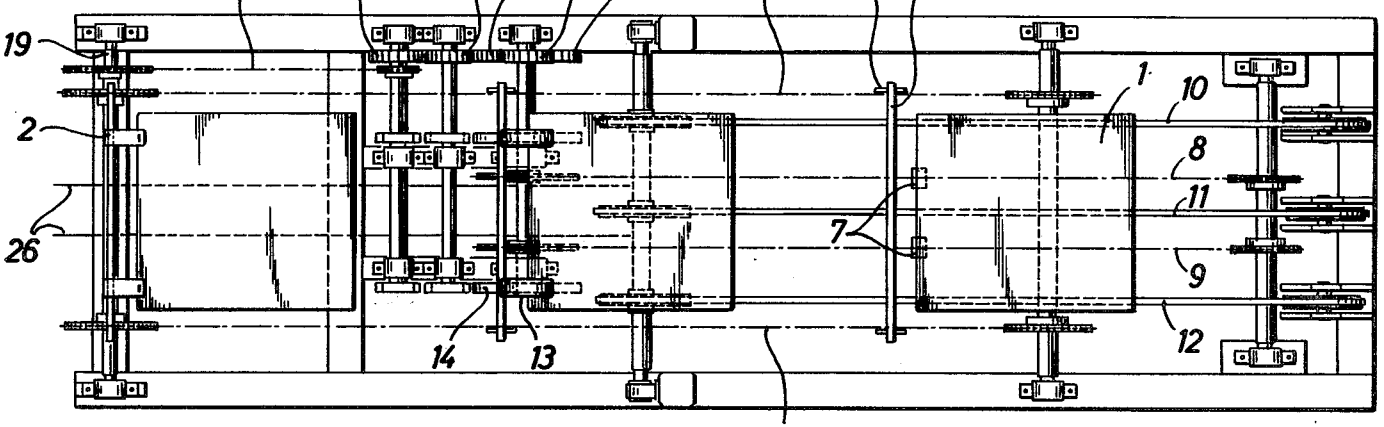
FIG. 5 is a plan view of the apparatus illustrated in FIG. 4.

FIGS. 4 and 5 show the means for applying the sheet 1, for introducing the cathode bars 3 into the carriers 4 and for inserting the sheet metal strips 2' which subsequently form the supporting eyes 2 from above in front of the elements 22 and 23 (not shown) because this can be carried out both by hand and also by automated mechanical devices of known type. In the interests of clarity, the stationary assembly 22, 23 has only been shown in FIG. 4.

The sheet 1 deposited onto the conveyors 10, 11, 12 on the right-hand side of the apparatus shown in FIGS. 4 and 5 is conveyed by these conveyors 10, 11, 12 against the stops 7 on the chain conveyors 8 and 9. The sheet 1 rests on the conveyors 10, 11, 12, for example in the form of belts, rubber belts or the like, which are driven at a higher speed than the chains 8 and 9 so that the sheet, which can slide on these belts 10, 11, 12, is always pressed against the stops 7. The carriers 4 for the cathode bars 3 are arranged on the chain conveyors 5 and 6 and, since the chain conveyors 5 and 6, on the one hand, and chain conveyors 8 and 9, on the other hand, travel at the same speed, a constant interval is maintained between the cathode bar 3 and the front edge of the sheet 1 which is in engagement with the stops 7.

During the further advancing movement in the direction of the arrow in FIG. 4, the cathode bar 3 comes into contact with the vertically projecting sheet metal strips 2', these sheet metal strips 2' being bent over by the cathode bar 3 continuing to move towards the left into the final shape of the supporting eyes 2 because they come into contact with the stationary holding means 22 and 23, for example round, inflexible rods or rollers, so that the upper and lower end of each sheet metal strip 2' is bent over. The sheet metal strips 2' are of course of corresponding length so that their ends come to rest on both sides of the sheet 1. In addition, the interval between the stationary means 22 and 23 is at least wide enough to allow the cathode bars 3 with the supporting eyes 2 bent over them to pass through. The sheet metal strips 2' preferably have the same thickness as the sheet 1 and, for this reason, may be cutout from a single sheet.

Accordingly, bending of the sheet metal strips 2' around the cathode bars 3 to form the supporting eyes 2 takes place continuously without stoppage of the transporting system.

Figure 2:
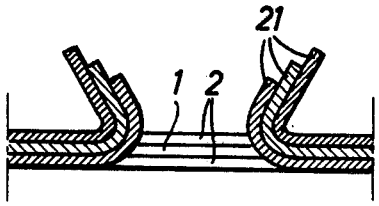
FIG. 2 is a section on an enlarged scale on the line *a—a* through the starting sheet illustrated in FIG. 1 showing the connection between the supporting eyes and the sheet at an intermediate stage.

During the further advancing movement, the assembly consisting of the cathode bar 3, the supporting eyes 2 bent around it and the sheet 1 arrives at the so-called punching station which, in FIGS. 4 and 5, is formed by pairs 13 and 14 of punching wheels. These punching wheels carry out a punching operation in the zone in which the ends of the supporting eyes 2 rest on the sheet 1, the end result of this punching operation being shown in FIG. 2. This FIG. shows three layers of sheets, the middle layer representing the sheet 1 and the two outer layers the ends of the supporting eyes 2. Tongues 21 are formed by the punching operation. The punching operation is carried out between the two punching wheels 13 and 14 with central mounting, in tangential contact with the sheet and in synchronism with the movement of the transporting system, one of the wheels comprising a suitable stamping arrangement which cuts the tongues out of the supporting eyes 2 and the sheet 1 in the manner illustrated in FIG. 2 and bends them. The other wheel acts as a stop.

Figure 3:
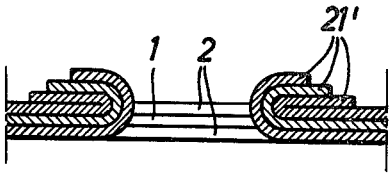
FIG. 3 is a section on an enlarged scale along the line *a—a* through the starting sheet illustrated in FIG. 1 showing the connection between the supporting eyes and the sheet in its final form.
Figure 8:
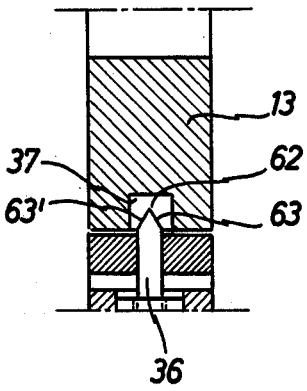
FIG. 8 is a partial section along the line 8—8 of FIG. 6 through the apparatus for establishing a first connection between the supporting eyes and the sheet.
Figure 9:
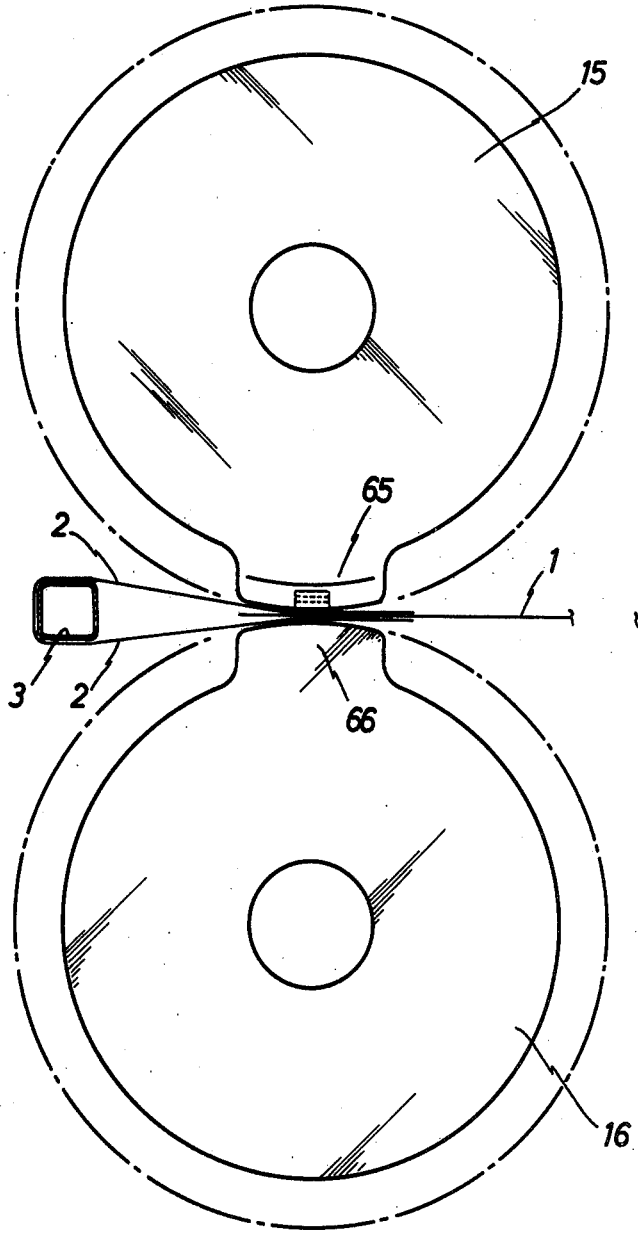
FIG. 9 is a side elevation on an enlarged scale of a pair of wheels for the further bending over of the tongues of the supporting eyes and the sheet.
Figure 12:
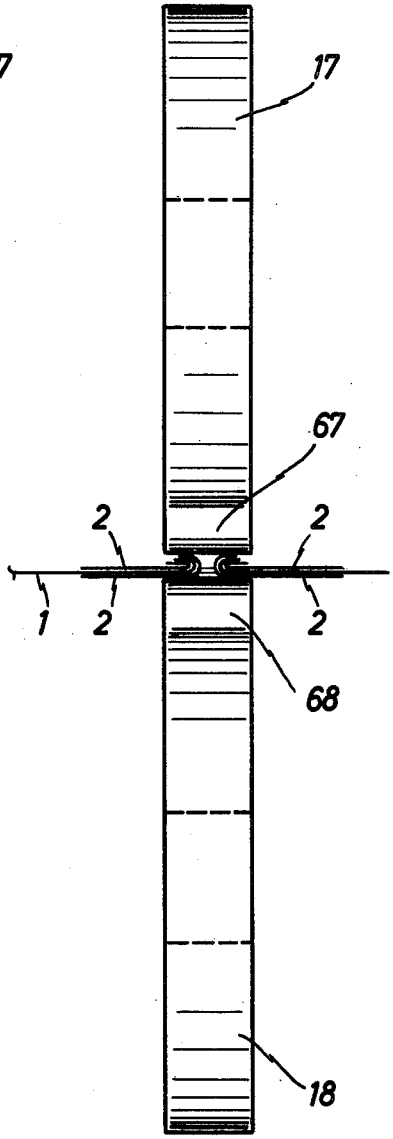
FIG. 12 is a front elevation of the pair of wheels shown in FIG. 11.

The firm, rigid connection 21' established between the sheet 1 and the supporting eyes 2 by means of the punch 36 and its structural configuration (cf. FIGS. 6 and 8) and by means of the bending and riveting stations illustrated in FIGS. 9 and 12 is diagrammatically illustrated in FIG. 3.

Figure 6:
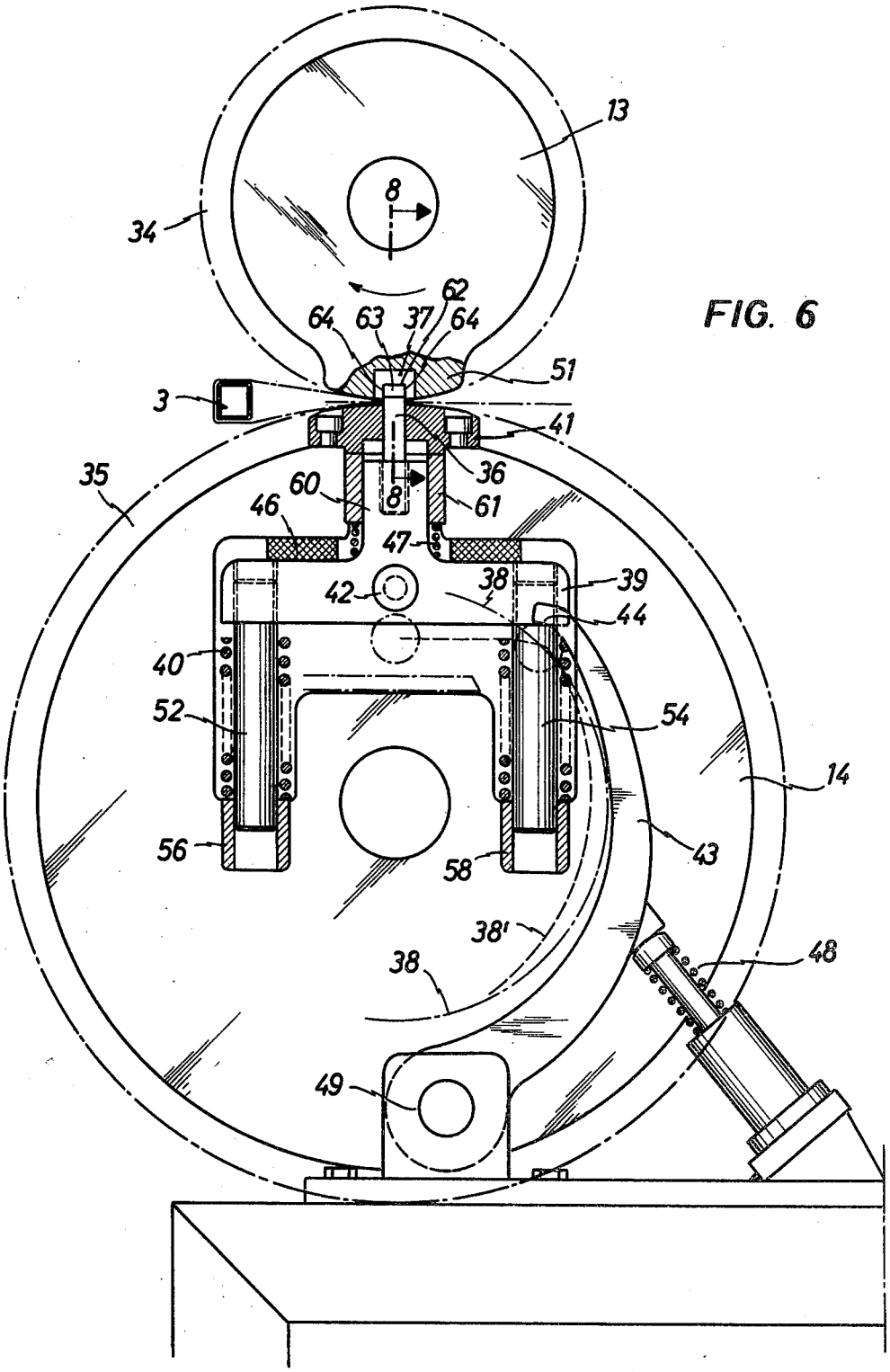
FIG. 6 is a side elevation on an enlarged scale, partly in section, of an apparatus for establishing a first connection between the supporting eyes and the sheet, the punch for forming the tongues in the supporting eyes and the sheet being shown in its frontmost, inserted position.
Figure 7:
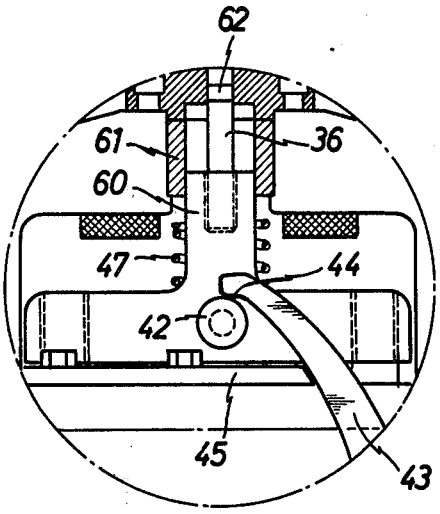
FIG. 7 is a partial elevation of FIG. 6, the punch for forming the tongues being shown in its withdrawn, spring-biased position.

As can best be seen from FIGS. 6, 7 and 8, the pair of wheels 13, 14 for establishing a first connection between the supporting eyes 2 and the sheet 1 and for forming tongues 21 and 21' in the supporting eyes and the sheet, comprise the punch 36 which is secured in a yoke-like member 39. In its frontmost and uppermost position illustrated in FIG. 6, the punch 36 projects into an opening 37 formed in a projection 51 on the counter wheel 13. The wheels 13 and 14 arranged on both sides of the path of movement of the sheet 1 and provided with openings 34 and 35 for the passage of the cathode bars 3 rotate at the same peripheral speed.

The clearance between the punch 36 and the opening 37 is adapted to the total thickness of the sheet and supporting eyes. The mechanism for inserting the punch 36 consists of a spring-mounted yoke 39 which transmits the spring force from the springs 40 to the punch 36. Spring bolts 52 and 54 are fixedly connected to the yoke 39, being guided in guide sleeves 56 and 58 secured to the punching wheel 14. The correct length of the punch 36 can be adjusted by screwing the punch 36 into an upper extension 60 of the yoke 39. The extension 60 is guided in a guide sleeve 61 secured to the punching wheel 14.

The compression of the springs 40 to obtain the necessary advancing force is obtained by successive compression during the rotation of the wheel 14, a toothed roller 42 secured to the yoke 39 moving along the path 38' on the inside of a stretching yoke 43 rather than around the circle 38. The toothed roller 42 is kept in front of its upper central position by the hook-like end section 44 of the stretching yoke 43 and is stretched with the stretching yoke 43 and the toothed roller 42 up to about the middle line, as a result of which the springs 40 are placed under tension. A stop 45 stops the stretching yoke 43, as a result of which the toothed roller 42 rolls out of the hook-like end section 44. This hook-like end section 44 releases the toothed roller 42 and, hence, the yoke 39 which accelerates upwards under the spring force and forces the punch 36 through the sheet 1 and the supporting eyes 2, the projection 51 on the wheel 13 provided with the opening 37 acting as an abutment.

The rubber dampers 46 intercept the yoke 39 in its highest position, the rebound effect produced by the rubber dampers 46 withdrawing the yoke 39 with the punch 36 so that the punch 36 is rapidly withdrawn from the sheet 1 and the supporting eyes 2. A spring 47 which, as shown in FIG. 6, acts on the guide sleeve 61 at its upper end and on the yoke 39 at its lower end, ensures that, during the further rotation of the wheel 14, the punch 36 which has rebounded is kept in an inner position in which the punch 36 does not project outwards beyond its guide 41.

By way of amplification of FIG. 6, FIG. 7 shows the stretching yoke 43 in the position in which it abuts against a stop 45 secured to the machine frame and is released by the toothed roller 42. The stretching yoke 43 is pivotally mounted on the machine frame at 49 so that it can be pivoted from its working position into a rest position when the resilient stop 48 is tilted to the side. It can be advantageous for the stretching yoke 43 to be pivoted automatically into its rest position or working position in dependence upon the presence of a sheet, a cathode bar and/or supporting eyes, in such a way that the yoke 39 is only tensioned when a sheet 1 is present and when a first connection is to be established, thereby ensuring that the punch 36 does not make any blank shots. The device for detecting the presence of the sheet, the cathode bar and/or the supporting eyes may be formed by microswitches, photocells or similar sensor and control means. The front cutting edge 62 and the oblique surfaces 63, 63' of the punch 36 are shown in FIG. 8. The oblique surfaces 63, 63' preferably include an angle of from about 50° to 70° and, more especially, an angle of about 60°.

Figure 10:
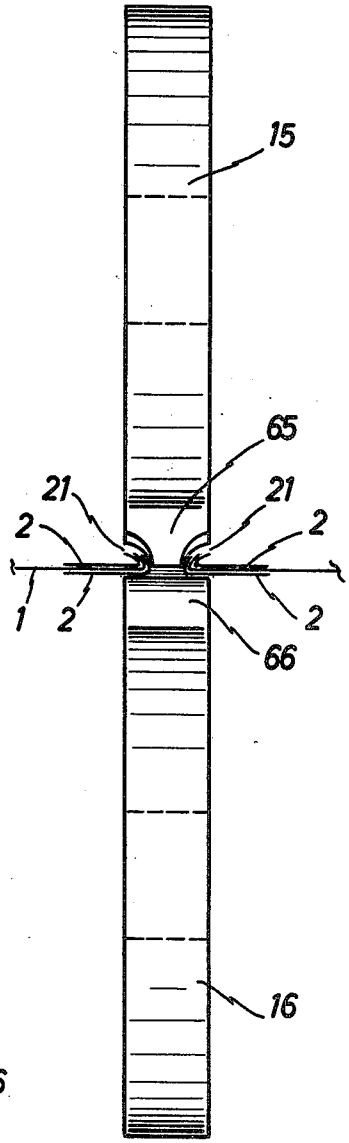
FIG. 10 is a front elevation of the pair of wheels shown in FIG. 9.

As shown in FIGS. 4, 9 and 10, the pair of wheels 13, 14 is followed by a pair of wheels 15, 16 which act as a bending station, the wheel 15 having a projection 65 provided with concave bending surfaces which bend the tongues 21 further over. The projection 66 of the wheel 16 acts as an abutment. Instead of concave bending surfaces, convex bending surfaces may also be provided.

Figure 11:
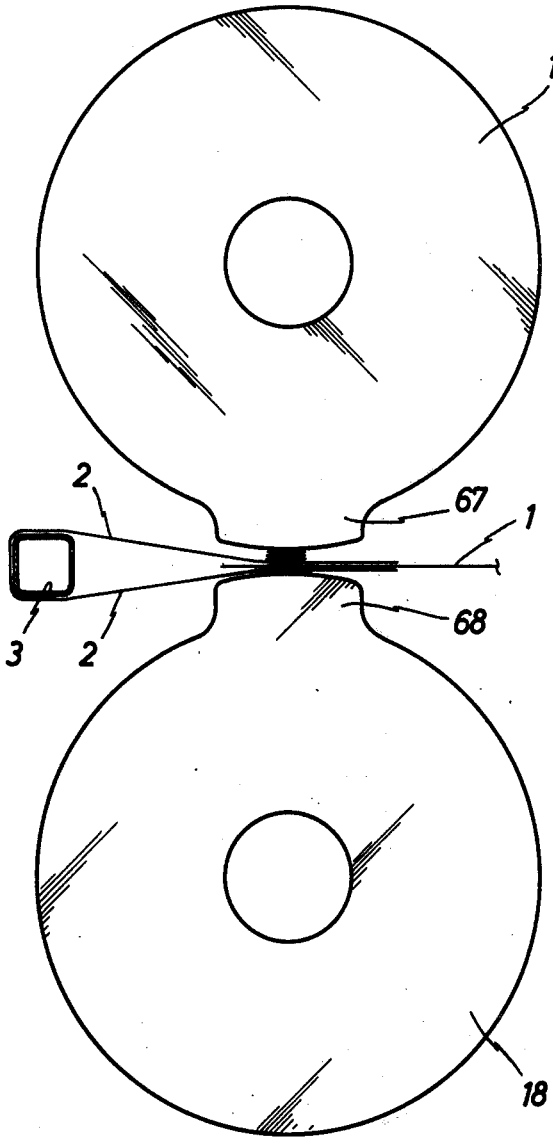
FIG. 11 is a side elevation on an enlarged scale of the pair of wheels forming the riveting station.

The bending station is followed by a riveting station comprising a pair of wheels 17, 18. The wheels 17, 18 are provided with projections 67 and 68, respectively (cf. FIGS. 11 and 12), and are pressed resiliently against one another in such a way that the tongues 21 and 21' are pressed firmly onto the sheet 1 and compressed therewith.

In the rearward zone of the apparatus shown in FIGS. 4 and 5, guide plates 26 are provided on which the sheet 1 slides when it is no longer supported on the belts 10, 11 and 12. FIG. 5 shows only the two middle plates of four guide plates 26. Pairs of gearwheels 13', 14'; 15', 16' and 17', 18' are provided coaxially with the pairs of wheels 13, 14; 15, 16 and 17, 18, respectively. Of these pairs of gearwheels, the gearwheels 16' and 18' are not visible in FIG. 5. These gearwheels ensure that all the wheels 13 to 18 of the above-mentioned pairs of wheels rotate at the same peripheral speed. Since the above-mentioned gearwheels are driven by the drive shaft 19 through a chain drive 25, it is also ensured that the peripheral speed of the wheels largely corresponds to the rate of travel of the chain conveyors 5, 6. The upper wheels 13, 15, 17 together with their gearwheels 13', 15', 17' and the intermediate gearwheels 20 are preferably mounted in a common frame which, as a whole, is mounted resiliently with respect to the machine frame and the lower wheels 14, 16, 18 fixedly mounted therein.

We claim:

1. A process for a continuous mechanical fabrication of starting sheets for an electrolytic refining of metals, especially copper, from pre-dimensioned and pre-straightened electrodeposited sheets, the process comprising the steps of:

continuously moving the respective starting sheets forward along a predetermined path of movement at a substantially constant rate of advance, imparting a movement component to components to be connected to the starting sheets and to tools for connecting the components to the starting sheets in a direction parallel to the predetermined path of movement of the starting sheets at a speed which substantially corresponds to the rate of advance of the starting sheets, and connecting the respective starting sheets to a cathode bar by supporting eyes by intermittently operating the tools which are arranged at predetermined positions along the predetermined path of movement of the starting sheets.

2. A process as claimed in claim 1, wherein the step of connecting includes operating the tools so as to cause the tools to act on the respective starting sheets in limited zones substantially perpendicularly of the plane of the starting sheets, and wherein the step of continuously moving the respective sheets includes supporting the starting sheets against forces directed substantially perpendicularly of the plane of the starting sheets.

3. A process as claimed in claim 1 wherein the step of connecting includes displacing the tools and associated counter tools along circular closed paths arranged in such a way that the circular paths extend substantially tangentially to the path of movement of the starting sheet.

4. A process as claimed in claim 3, characterized in that the step of connecting further includes providing sheet metal strips for forming the supporting eyes, bending the sheet metal strips around the cathode bar so that ends thereof are in contact with the respective starting sheets on both sides during the continuous advancing of the starting sheets, cathode bar and supporting eyes, establishing a first connection between the respective starting sheets and supporting eyes by operating a tool so as to punch through the ends of the supporting eyes and through the starting sheets to form tongues, and converting the first connection into a firm rigid connection by at least one of a subsequent bending or riveting of the tongues.

5. A process as claimed in claim 4, characterized in that the step of establishing a first connection includes providing at least one punch having at least a front cutting edge and oblique surfaces acting as bending tools, and operating the at least one punch at high speed through the supporting eyes and the starting sheets to establish the first connection between the supporting eyes and the starting sheets.

6. A process as claimed in claim 5, characterized in that the at least one punch has a rectangular cross-section with the oblique surfaces extending rearwardly gable-like from the front cutting edge substantially parallel to the surface of the starting sheets and with lateral surfaces of the punch forming lateral cutting edges, and in that the step of operating the at least one punch includes forcing the at least one punch to cut into the starting sheets and the supporting eyes so that the tongues are bent laterally by the gable-like oblique surfaces of the at least one punch.

7. A process as claimed in claim 6, characterized in that the step of operating the at least one punch includes inserting the at least one punch into the assembly formed by the sheet and the supporting eyes by a distance corresponding to at least about the total thickness of the starting sheet and the supporting eyes beyond the gable-like oblique surfaces of the at least one punch.

8. A process as claimed in claim 7, characterized in that the step of directing the at least one punch further includes driving the at least one punch into the assembly formed by the sheet and the supporting eyes by one of a suddenly released spring tension or compressed air or gases.

9. An apparatus for a continuous mechanical fabrication of starting sheets for an electrolytic refining of metals from pre-dimensioned and pre-straightened electrodeposited sheets, the respective starting sheets being adapted to be connected by supporting eyes to a cathode bar, the apparatus including transporting means for transporting the respective starting sheets and cathode bars, means for continuously driving the transporting means at a constant speed, means for punching the respective starting sheets and supporting eyes, and means for mechanically establishing a firm rigid connection between the supporting eyes and the respective starting sheets, characterized in that the transporting means includes a first conveyor means for advancing the cathode bars including carrier means for carrying the cathode bars, and second conveyor means for advancing the respective starting sheets including stop means for engaging at least a portion of the respective starting sheets, means for operatively connecting said first and second conveyor means to said driving means such that said first and second conveyor means are driven at substantially the same speed thereby maintaining a constant interval between the cathode bar and the starting sheet during an advancing movement at least over a first portion of the transporting means, stationary means for picking up and holding sheet metal strips and for forming the sheet metal strips into the supporting eyes, said stationary means are arranged such that the sheet metal strips are bent around the cathode bar during the advancing movement of the starting sheets and cathode bars so that ends of the supporting eyes formed from the sheet metal strips rest on both sides of the starting sheet at an upper end thereof, and in that means are provided for mounting the punching means and the mechanical connection means so as to be displaceable to thereby connect the ends of the supporting eyes to the respective starting sheets.

10. An apparatus as claimed in claim 9, characterized in that the mounting means for the punching tool and mechanical connection means include displaceable members arranged at the apparatus so as to permit the punch tool and mechanical connection means to be displaced along curved paths, and in that means are provided in said mounting means for permitting a passage of the cathode bars therethrough.

11. An apparatus as claimed in claim 10, characterized in that the displaceable members include at least a first co-operating pair of roller means having the punching means mounted thereon, said first pair of roller means being arranged so as to simultaneously punch out tongues both from the supporting eyes and from the starting sheets, at least a second co-operating pair of roller means including means for bending over the tongues punched out by the punching means, and at least a third co-operating pair of roller means having mounted thereon said mechanical connection means, and in that said mechanical connection means includes one of compressing means, riveting means or welding means.

12. An apparatus as claimed in claim 11, characterized in that the punching means includes a punching tool, means are provided for mounting the punching tool in one roller means of the first pair of roller means for radial displacement with respect to said roller means, said punching tool mounting means permitting a displacement of the punching tool into the path of movement of the starting sheet beyond circumference of the roller means, and in that the punching tool includes a front cutting edge having oblique surfaces acting as bending tools, and in that at least one spring means is operatively connected with the punching tool so as to permit the punching tool to be displaced at high speed through the supporting eyes and the starting sheet.

13. An apparatus as claimed in claim 12, characterized in that several pairs of co-operating roller means each having bending means are provided and are arranged one behind the other in the direction of movement along the predetermined path of movement of the starting sheets for successively bending over the tongues punched by the punching tool, the bending means of the last-mentioned pair of co-operating roller means defining a predetermined wedge angle which increases in the direction of movement of the starting sheets, and in that the punching tool has a rectangular cross-sectional configuration, the oblique surfaces extend rearwardly gable-like from the front cutting edge so as to extend substantially parallel to the surface of the starting sheets and form lateral cutting edges with lateral surfaces of the punching tool.

14. An apparatus as claimed in claim 13, characterized in that the oblique surfaces of the punching tool include an angle of between about 50° to 70°.

15. An apparatus as claimed in claim 14, characterized in that the means for mounting the punching tool includes a yoke-like means mounted for radial displacement in said one roller means of the first pair of co-operating roller means, said at least one spring means being operatively connected with said yoke-like means, and in that a stretching yoke means is provided for automatically tensioning said at least one spring means upon each revolution of the roller means, said stretching yoke means being pivotally mounted so as to be displaceable between a working position and a rest position, and means are provided for suddenly releasing the punching tool when the punching tool aligns with an opening in an abutment projection provided on the other roller means of the first pair of co-operating roller means.

16. An apparatus as claimed in claim 15, characterized in that means are provided for automatically pivoting the stretching yoke means from the working position into the rest position in dependence upon the presence of at least one of the starting sheet, the cathode bar or the supporting eyes.

17. An apparatus as claimed in claim 16, characterized in that means are provided for resiliently mounting at least one roller means of at least one of the pairs of co-operating roller means.

18. A process as claimed in claim 1, wherein the step of connecting includes displacing the tools and associated counter tools along circular closed paths arranged in such a way that the circular paths extend substantially tangentially to the path of movement of the starting sheet.

19. A process as claimed in claim 1, characterized in that the step of connecting includes providing sheet metal strips for forming the supporting eyes, bending the sheet metal strips around the cathode bar so that ends thereof are in contact with the respective starting sheets on both sides during the continuous advancing of the starting sheets, cathode bar and supporting eyes, establishing a first connection between the respective starting sheets and supporting eyes by operating a tool so as to punch through the ends of the supporting eyes and through the starting sheets to form tongues, and converting the first connection into a firm rigid connection by at least one of a subsequent bending or riveting of the tongues.

20. A process as claimed in claim 1, characterized in that the step of connecting includes providing at least one punch having at least a front cutting edge and oblique surfaces acting as bending tools, and operating the at least one punch at high speed through the supporting eyes and the starting sheets to establish the first connection between the supporting eyes and the starting sheets.

21. A process as claimed in claim 20, characterized in that the at least one punch has a rectangular cross-section with the oblique surfaces extending rearwardly gable-like from the front cutting edge substantially parallel to the surface of the starting sheets, and with lateral surfaces of the punch forming lateral cutting edges, and in that the step of operating the at least one punch includes forcing the at least one punch to cut into the starting sheets and the supporting eyes so as to bend tongues produced by the punch laterally by the gable-like oblique surfaces of the at least one punch.

22. A process as claimed in claim 1, wherein the step of connecting includes supporting the starting sheets against forces directed substantially perpendicularly of the plane of the starting sheets by counter tools at least in zones adjacent a contact point of the tools with the respective starting sheets.

23. A process as claimed in claim 22, wherein the step of connecting includes operating the tools so as to cause the tools to act on the respective starting sheets in limited zones substantially perpendicularly of the plane of the starting sheets.

24. A process as claimed in claim 1 wherein the step of connecting includes operating the tools so as to cause the tools to act on respective starting sheets in limited zones of the starting sheets.

25. A process as claimed in claim 24, wherein the step of connecting further includes supporting the starting sheets by counter tools at least in zones adjacent a contact point of the tools with the starting sheets against forces directed substantially perpendicularly of the plane of the starting sheets.

26. A process as claimed in claim 25, wherein the step of connecting further includes applying force to the respective starting sheets non-perpendicularly of the plane thereof in pairs by the tools and counter tools in substantially the same magnitude and in opposite directions in such a way that the resulting force component in the plane of the respective starting sheets is substantially zero.

27. A process as claimed in claim 1, wherein the step of connecting includes applying forces to the respective starting sheets non-perpendicularly of the plane thereof in pairs by the tools and counter tools in substantially the same magnitude and in opposite directions in such a way that the resulting force component in the plane of the respective starting sheets is substantially zero.

28. An apparatus as claimed in claim 10, characterized in that the displaceable bodies are rotatably mounted at the apparatus.

29. An apparatus as claimed in claim 11, characterized in that the displaceable bodies are constructed as one of rollers, wheels or segments of a wheel.

30. An apparatus as claimed in claim 14, characterized in that the angle of the oblique surfaces is about 60°.

31. An apparatus as claimed in claim 13, characterized in that the punching tool has a square cross-sectional configuration.

* * * * *